US006849854B2

(12) United States Patent
Sainty

(10) Patent No.: US 6,849,854 B2
(45) Date of Patent: Feb. 1, 2005

(54) ION SOURCE

(75) Inventor: Wayne Gregory Sainty, Monash Park (AU)

(73) Assignee: Saintech Pty Ltd., Sydney (AU)

( * ) Notice: Subject to any disclaimer, the term of this patent is extended or adjusted under 35 U.S.C. 154(b) by 0 days.

(21) Appl. No.: 10/706,814

(22) Filed: Nov. 13, 2003

(65) Prior Publication Data

US 2004/0251410 A1 Dec. 16, 2004

Related U.S. Application Data

(63) Continuation-in-part of application No. 09/744,205, filed on Jan. 18, 2001, now Pat. No. 6,734,434.

(51) Int. Cl.[7] ..... H01J 49/10; H01J 49/12

(52) U.S. Cl. ..... 250/423 R; 250/427; 315/111.81; 315/111.91; 313/362.1

(58) Field of Search ..... 250/423 R, 427; 315/111.81, 111.91; 313/362.1

(56) References Cited

U.S. PATENT DOCUMENTS 4,862,032 A * 8/1989 Kaufman et al. ..... 313/359.1
6,608,431 B1 * 8/2003 Kaufman ..... 313/231.31
6,645,301 B2 * 11/2003 Sainty ..... 118/665
6,750,600 B2 * 6/2004 Kaufman et al. ..... 313/361.1

* cited by examiner

*Primary Examiner*—Nikita Wells

(57) ABSTRACT

An ion source 10 for producing a beam of ions from a plasma is disclosed. A plasma is created at the center of an anode 12 by collisions between energetic electrons and molecules of an ionizable gas. The electrons are sourced from a cathode filament 11 and are accelerated to the anode 12 by an applied electric potential. A projection of the anode and a magnetic field having an axis aligned with the axis of the anode act together to concentrate the flow of electrons to the center of the anode 12. The ionizable gas is introduced into an ionization region 13 of the ion source 10 at the point of concentrated electron flow. Ions created in the ionization region are expelled from the ion source as an ion beam centred on the axis of the magnetic field. The surfaces of the anode are coated with an electrically conductive non-oxidising layer of Titanium Nitride to prevent a build up of an insulating layer on the anode.

53 Claims, 5 Drawing Sheets

ION SOURCE

CROSS REFERENCES TO RELATED APPLICATIONS

This application is a continuation-in-part of Application Ser. No. 09/744,205, filed 18 Jan. 2001 now U.S. Pat. No. 6,734,434, the entire contents of which are incorporated herein by reference.

BACKGROUND OF THE INVENTION

This invention relates to ion sources for producing an ion beam. The invention was developed through use with end-Hall effect ion sources and is, at times, described with particular reference thereto. It will be apparent to the skilled reader however, that the scope of the invention will encompass other types of ion sources.

Ion sources had their origins in space propulsion but more recently have found use in more industrial processes such as Ion Assisted Deposition (IAD) of thin film coatings. In an IAD process, an ion beam from an ion source is directed onto a target substrate to cause densification of the coating material as it is deposited. The process occurs within an evacuated chamber of pressure of the order $10^{-2}$ Pa.

In a typical ion source, electrons are drawn from a cathode filament toward an anode through an ionizable gas. Collisions between the gas molecules and energetic electrons create a source of positive ions by inducing a plasma. In one type of ion source known as a gridless ion source, a magnetic field is applied across the plasma to shape the ions accelerated from the ion source into an ion beam. In a specific type of gridless ion source, known as an end-Hail effect ion source, the axis of the magnetic field is aligned with the electric potential between the cathode and the anode. The interaction of the magnetic and electric fields causes the charged particles to approximately follow the magnetic field lines. The anode in these devices is typically annular having an outwardly inclined inner diameter with the bulk of the plasma forming within the confines of the anode walls.

An example of an end-Hall effect ion source in common use, in particular in IAD techniques, is described in U.S. Pat. No. 4,862,032 to Kaufman el al. In this device, herein referred to as the Kaufman device, the ionizable gas is distributed uniformly across the plasma region. Magnetic field shaping disperses the electrons across the gas to ensure a large plasma capable of producing a high ion beam current. The result is that a relatively high gas flow (typically up to 50 sccm) is required maintain a sufficient pressure in the plasma region to achieve ionization of the gas. The resultant high background pressure within the interelectrode space creates electrical instability leading to the generation of cathode spots within the ion source and extending to the extremities of the vacuum environment. In addition, large vacuum pumps are required to maintain a sufficiently low pressure within the rest of the evacuated chamber to be compatible with the operation of other equipment used in IAD and other processes. In operation the pressure can only be increased to the point where the ion beam current is approximately 1 Amp before further instabilities are introduce.

A further problem with present ion sources is that their performance can decrease over the life of the ion source. Symptoms include difficulty in establishing the plasma and a reduced stability of the plasma. Investigations by the present inventor have found that the reduced performance capabilities are created, at least in part, by a decrease in the electron flux entering the ionization region due to a reduction in the effective surface potential of the anode. Further investigation into the cause of the reduced potential by the present inventor found that a dielectric oxide layer built up on the surface of the anode exposed to the plasma. It was previously believed that the observed build up of electrically insulating coatings on the anode were produced by scattering and sputtering from the thin film deposition processes for which these ion sources were commonly used. The inventor has found that the dielectric layer actually arises from a small percentage of negative ions produced in an oxygen plasma interacting with the surface of the anode and that this has the effect of shielding the anode from the cathode, dispersing the electron flow from the cathode and thus reducing the electron flux into the ionization region. The reduced electron flux into the ionization region firstly creates instability in the performance of the ion source and, secondly, causes an imbalance in the change neutrality of the resultant ion beam.

SUMMARY OF THE INVENTION

In a first form, the present invention resides in an ion source comprising an electron producing cathode, an anode, an ionization region between said cathode and said anode, a gas supply path for introducing an ionizable gas into said ionization region, means for creating a potential difference between said cathode and said anode to produce a flow of electrons from said cathode toward said anode, said electron flow passing substantially through said ionization region and causing ionization of said gas, said potential difference also acting to expel ions created in said ionization region from said ion source, means for concentrating said electron flow to crate a region within said ionization region where the electron flux is a maximum, wherein said gas supply path terminates in at least one aperture disposed in proximity to said region of maximum electron flux.

Preferably the ion source includes a magnet. More preferably, the axis of the magnetic field lies substantially parallel to the direction of the electric potential between the anode and the cathode. With the magnetic and electric fields aligned in this way, the maximum electron flux occurs at the maximum magnetic field intensity.

Preferably the anode includes a projection extending into the ionization region for concentrating the electron flow.

The invention also provides an ion source comprising an electron producing cathode, an anode, an ionization region between said cathode and said anode, a gas supply path for introducing an ionizable gas into said ionization region, means for creating a potential difference between said cathode and said anode to produce a flow of electrons from said cathode toward said anode, said electron flow passing substantially through said ionization region and causing ionization of said gas; said potential difference also acting to expel ions created in said ionization region from said ion source, wherein said anode has at least one surface exposed to said ionization region, at least a portion of said at least one surface being of an electrically conductive non-oxidizing material.

Preferably the anode is annular having an axis lying in the same direction as the electric field between the anode and the cathode. The exposed surfaces of the anode are preferably a coating of Titanium Nitride (TiN).

BRIEF DESCRIPTION OF THE DRAWINGS

Further features and advantages of the invention will become apparent to the skilled reader from the following description of preferred embodiments made with reference to the accompanying Figures in which.

DESCRIPTION OF PREFERRED EMBODIMENTS

Figure 1:
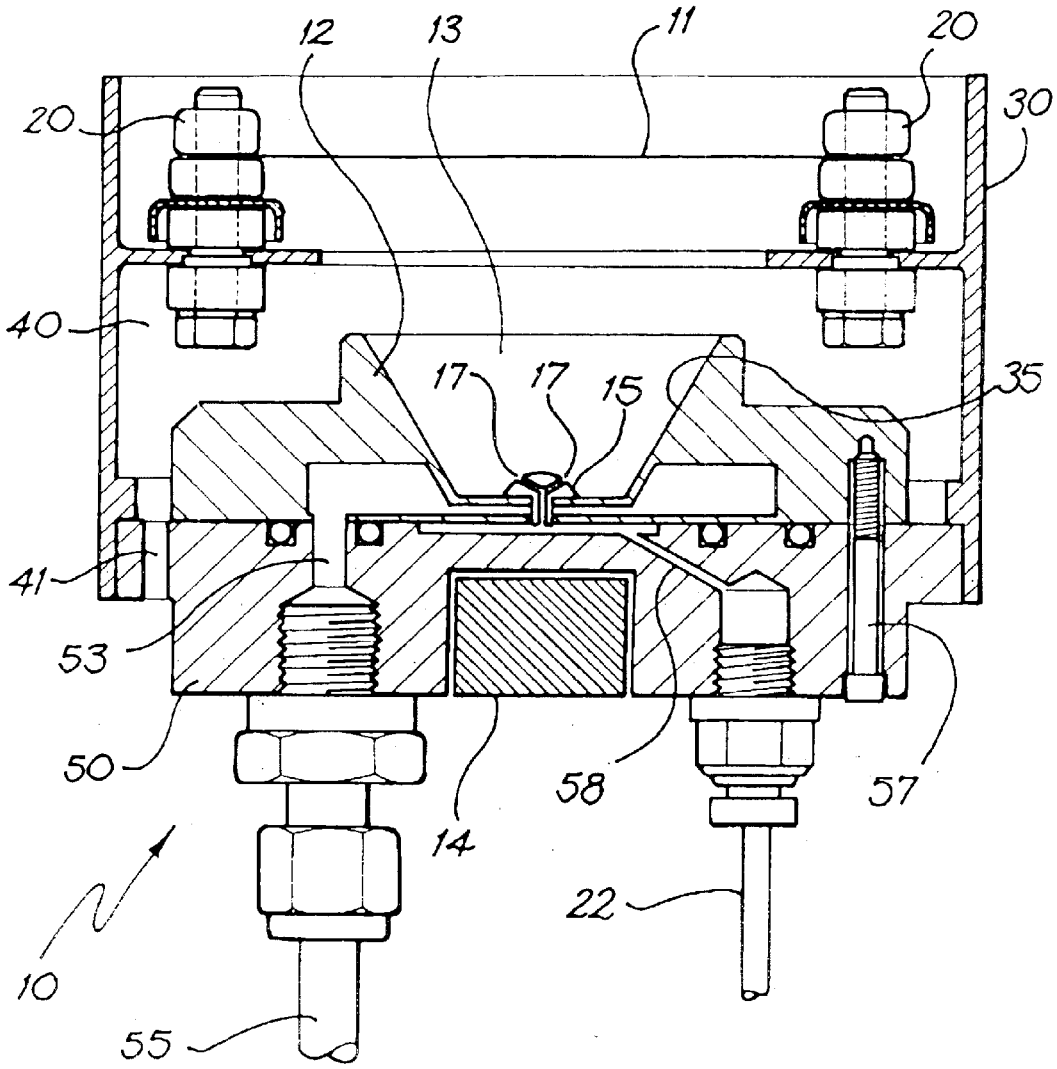
FIG. 1 is a partial cross-sectional elevation of the ion source according to the invention.
Figure 2:
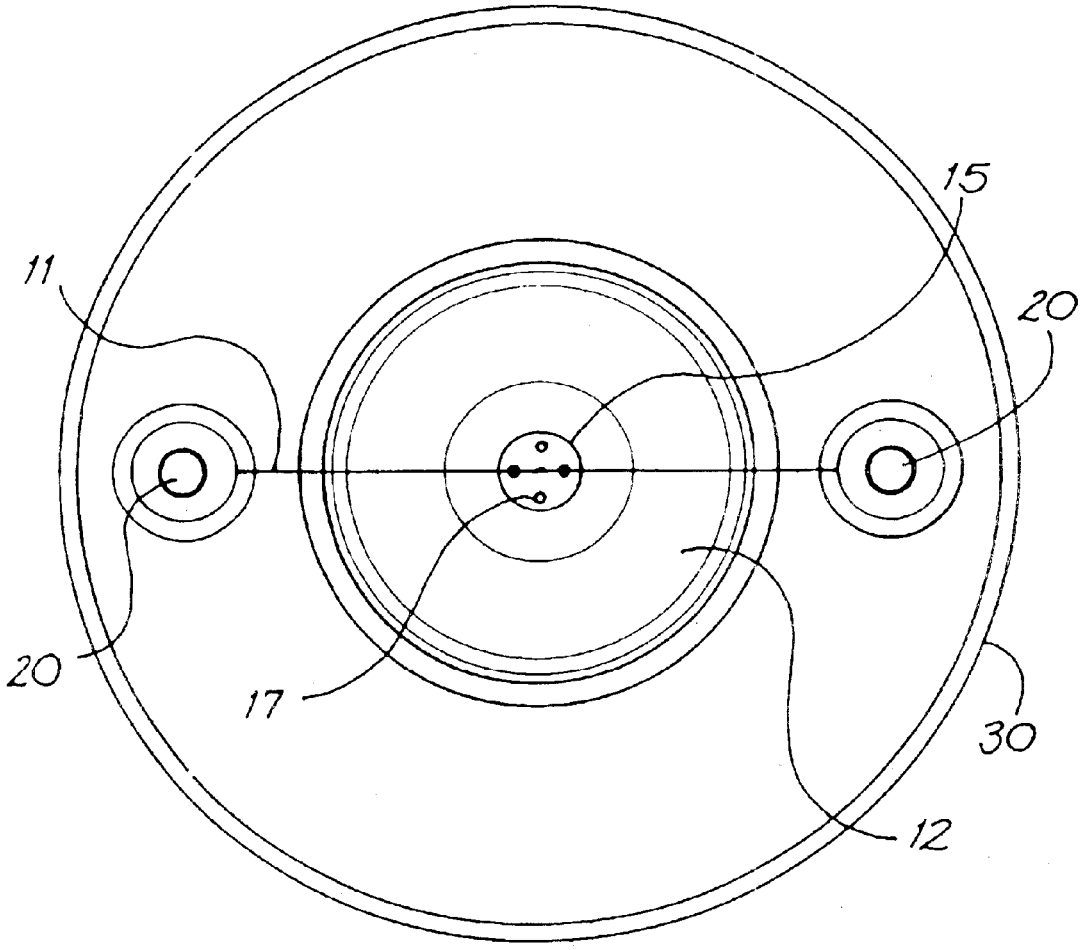
FIG. 2 is a plan view of the ion source in FIG. 1.

FIGS. 1 and 2 show an ion source generally at 10 having a cathode wire 11 and an anode 12. The anode 12 has an inner surface 35 sloping outwards in the direction of the cathode. Between the cathode 11 and the anode 12 is an ionization region 13. The cathode wire 11 is suspended above the anode by two mounting pins 20 that are held by, and in electric isolation from a shield plate 30. The shield plate 30 substantially surrounds the anode, cathode and ionization region by extending from a point lower than the anode 12 to a point above the cathode 11 and is preferably maintained at earth potential to shield the anode and the cathode from external fields.

A magnet 14 is disposed outside the ionization region 13 but adjacent the anode 12. The magnet 14 creates a magnetic field, the longitudinal axis of which is aligned with the axis of the anode 12. The magnet may be a permanent magnet or an electromagnet. Preferably the magnet is a high flux rare earth magnet such as a NdFeB magnet. As an alternative, magnet 14 may be a ring magnet disposed around the anode 12 and ionization region 13.

The alignment of the magnetic field with the electric field causes electrons emitted by the cathode to approximately follow the magnetic field lines as they move towards the anode. This has the effect of concentrating the flow of electrons toward the axis of the magnetic field. Therefore the region where the magnetic field intensity is a maximum will also be a region of maximum electron flux.

The ionizable gas, for example oxygen, nitrogen or argon, is supplied to the ionization region through a gas flow path from gas feed line 22. The gas flow path terminates at an outlet member 15. The outlet member 15 has the form of a gas shower head, with a plurality of apertures 17, that introduce the gas into the ionization region 13 in a substantially random direction. The gas shower head 15 is disposed on the axis of the anode and adjacent the ionization region 13 such that gas emanating from the apertures 17 enters the ionization region at a point of high electron flux. Because a large proportion of ionization occurs close to the outlet, the gas shower head is of a material such as stainless steel, that withstands the very high energy from the incoming electron flux The anode 12 preferably has disposed within it a channel 53 in communication with a fluid conduit 55 that provides water to cool the anode. The channel 53 preferably extends into the body of the outlet member 15.

The anode 12, outlet member 15 and shield 30 are mounted on a non conductive mounting base 50 through which extends the gas flow path and fluid conduit 55. A plurality of mounting screws 57 fix the anode 12 to the base 50. The magnet 14 is housed within the base such that the external pole is exposed. The mounting base 50 has a conduit 58 that forms part of the gas flow path and connects the gas feed line 22 to the outlet member 15 such that no electrical connection can be made between the outlet member 15 and the gas feed line 22. The mounting base 50 has a similar conduit for connecting the water feed line 55 to the channel 53. The gas and water feed lines preferably screw into the mounting base 50. A suitable material for the mounting base 50 is glass filled polytetrafluoroethylene. This arrangement reduces electrical hazards, simplifies mounting and installation and reduces risk of secondary plasmas forming within the gas feed line.

The size of the outlet is preferably half or less than the smallest inner diameter of the anode in order that a localised high pressure zone is created around the outlet, that decreases rapidly with distance.

In operation the anode is charged in the range 0–500 V, preferably 250 V relative to the cathode which is at or near earth potential. A DC current of approximately 12A is passed through the cathode to stimulate electron emission. An AC current may be used but the combination of an alternating current and the magnetic field has been found to cause vibrations in the cathode which reduces the cathode lifetime. Electrons generated at the cathode are influenced by the anode potential and are accelerated toward it. The magnetic field imparts a spiral motion on the electrons further increasing their potential to ionize gas molecules and focussing the electrons toward the longitudinal axis. Collisions between the energetic electrons with gas molecules emitted from the outlet member 15 cause ionization. If sufficient ionizing collisions occur then a plasma is formed. Positive ions created in the plasma experience the opposite effect to the electrons. The ions initially have a random velocity but are influenced by the electric potential gradient which accelerates them toward and past the cathode 11. The magnetic field in this case acts to control the direction in which the ions are expelled from the ion source by focusing them into an ion beam centered on the longitudinal axis of the magnetic field. The dynamics of the interactions between the ions and the electric and magnetic fields for this configuration are known per se, for example from the above mentioned Kaufman patent. The current of the ion beam is effected by the size of the plasma which can be controlled by the gas flow rate.

The anode 12 is preferably made of stainless steel but has a coating of a non-oxidising electrically conductive material, for example TiN, on the inner surface 35 and any other surface that in use may be exposed to bombardment by electrons and/or negative ions from the plasma. The inner surface coating is unreactive with any negative ions produced in the plasma and therefore resists the build up of a dielectric layer on the anode surface. This provides a long term benefit in the performance of the ion source because a dielectric coating would shield the anode potential from the cathode. This would reduce the concentration of electrons flowing into the ionization region, thus reducing the size of the plasma and in turn the ion beam current. In addition, the concentration of electrons in peripheral regions of the ion source would increase, thereby increasing the frequency of arcing and sputtering in these regions. By coating the anode in a non-oxidising material, these problems can be eliminated as can the cleaning procedures previously required to maintain the anode in working order.

Figure 3:
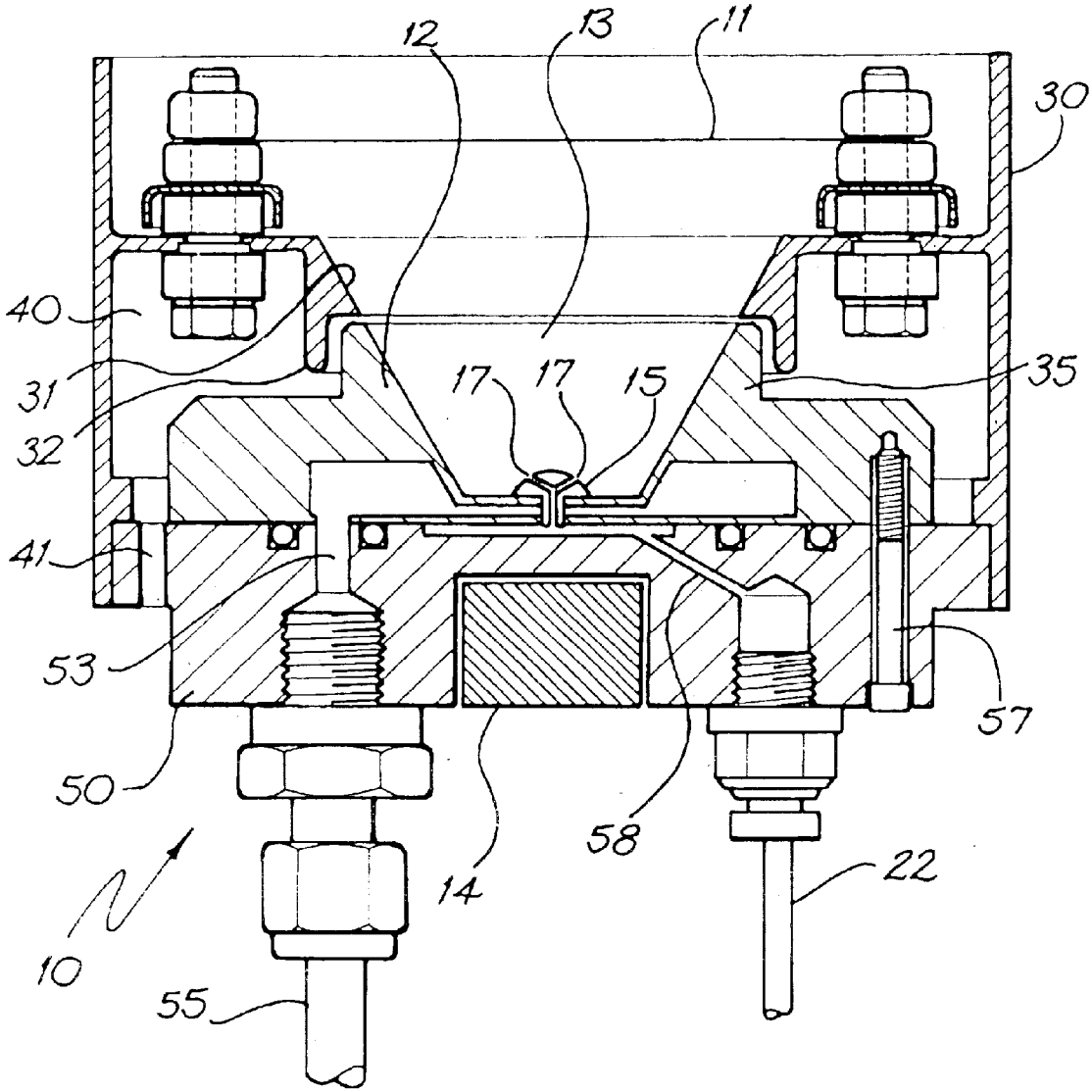
FIG. 3 is a cross-sectional view of a preferred form of the invention.

The ion source 10 can operate at a lower background pressure than prior art ion sources, allowing the anode and cathode to be in closer proximity than in previous devices. FIG. 3 shows a preferred form of the invention where the inner edge 31 of the plasma shield 30 extends towards the anode 12. Preferably the inner edge 31 of the shield 30 is disposed outside a projection of the inner surface 35 of the anode 12. The extended edge 31 has a flange 32 that surrounds an upper portion of the anode 12. The purpose of the flange 32 is to prevent gas entering the region 40 enclosed by the anode 12 and shield 30 where the gas could be ionized and cause electrical instability. A vent hole 41 is provided from the region 40 to outside the ion source to allow sufficient pumping of this region, thus ensuring a low pressure. To further prevent any instabilities an o-ring seal (not shown), preferably of an elastomer material, can be disposed between the flange 32 and an upper portion of the anode 12.

An ion source having an alternative construction and gas delivery method is described with reference to FIG. 4. The ion source 100 includes a base plate 101 that screws or otherwise engages with a cylindrical shroud 102. The shroud has an inner sloping surface 103 that defines an open end 116 of an ionization region 113 to be described below. The base plate 101 has a collar 105, extending upward from which is a threaded section 106 for engagement with the shroud 102. The base 101 has an upper annular face 107. An inner circumferential flange 108 extends from the face 107 to locate a ring magnet 114 thereon.

Disposed on the magnet 114 is a spacer 117, for example of aluminium, that provides a radiation shield to prevent the magnet 114 from overheating due to radiation from the anode 112.

The anode 112 has an end wall 120 and an outwardly sloping side wall 121. The side wall and end wall together define the ionization region 113. A filament 111 is supported at the open end 116 of the ionization region 113 by filament support legs 130. The filament legs 130 are connected to the shroud 102 through insulating mountings 131 to electrically isolate the filament legs 130 from the shroud 102. The filament legs 130 are each electrically conducting and have an electrical connection point 132 for connecting into a filament supply circuit (not shown).

A projection 123 extends from the anode end wall 120 into the ionization region 113. The projection 123 shown in FIG. 4 is curved having an apex located on an axis of the anode. In alternative embodiments, the projection may have angled aces or the like. The projection provides a focal point for the electrons emitted by the cathode. The anode 112 is located within the shroud by upper and lower insulating rings 118, 119. A gas chamber 140 is defined by the anode 112, the insulating rings 118, 119 and the inside surface of the shroud 102. The upper insulator 118 is a rigid insulator for holding and locating the anode 112 properly in place. The insulator 118 is also required to have a high temperature resistance and low thermal expansion in order that the insulator provides a seal for the gas chamber under operating conditions. Preferred materials for the upper insulator include glass, ceramic or some polymers such as PEEK (polyethylethylketone ). The lower insulator is preferably a high temperature elastomer ring that provides a resilient seal for the gas chamber 140 when the base 101 is screwed into the shroud.

An inlet 141 through the shroud is connectable to a gas line (not shown) that supplies gas to the gas chamber 140. Control of the gas flow is governed by a mass flow controller or similar control mechanism disposed upstream of the ion source, as is well known in the art Extending through the anode side walls 121 are a plurality of channels 125, each terminating in the ionization region 113 at an aperture 126 disposed adjacent the end wall 120. The channels 125 provide a conduit from the gas chamber 140 to the ionization region 113. The channels 125 extend downwardly (as depicted in FIG. 4) from the outer anode wall to the ionization region such that the channels are pointed at the projection 123. This ensures that the incoming gas molecules are on average directed at the projection 123. Gas ionization efficiency is thereby increased because the gas molecules are introduced in proximity to the region of highest electron concentration and electron energy.

Figure 4:
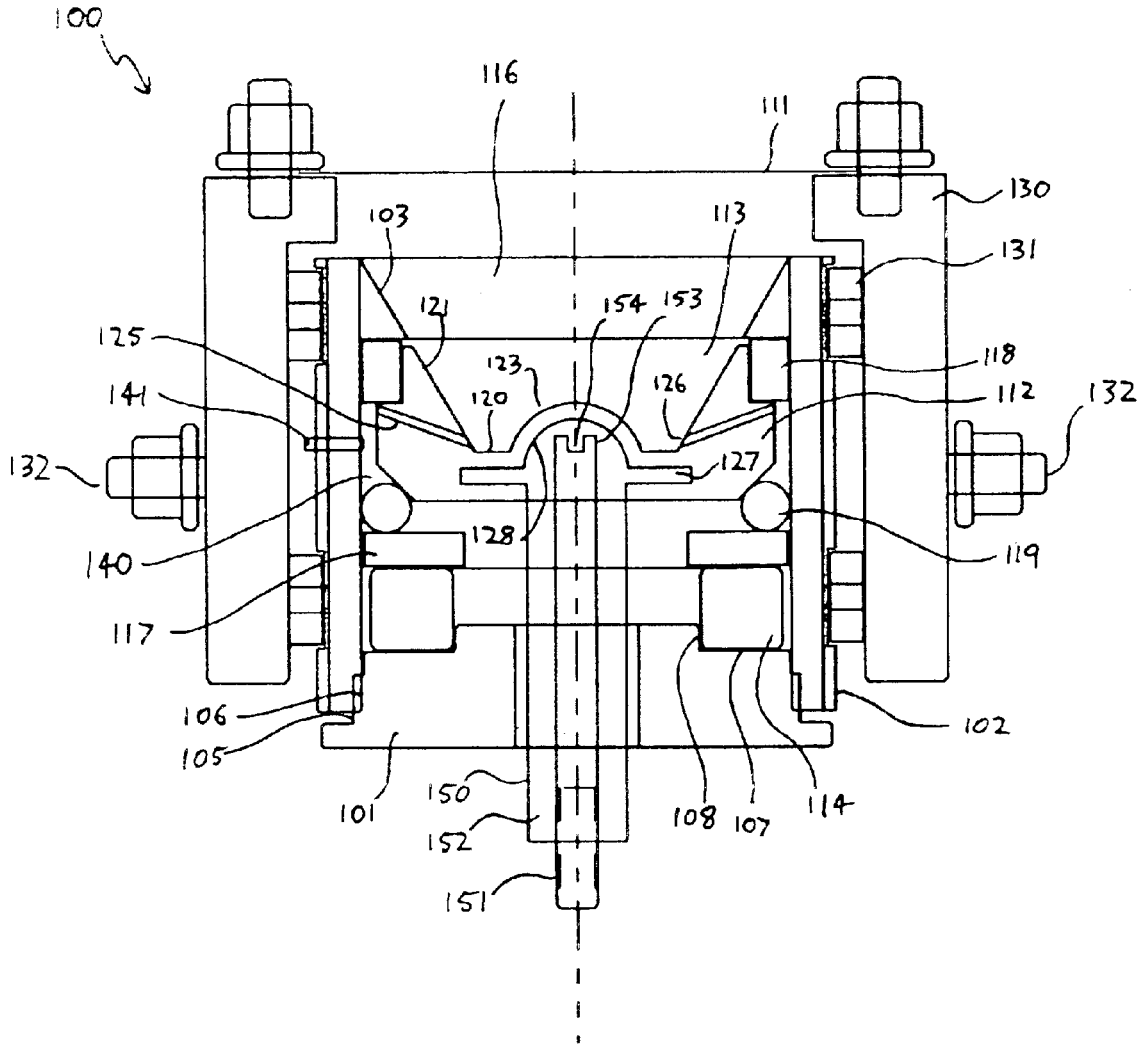
FIG. 4 shows a schematic of an alternative gas supply for an ion source.

As shown in FIG. 4, the projection 123 is integrally formed with the end wall 120. Also shown within the anode 112 is a cavity 127 that receives a cooling fluid from an inlet conduit 150. The cavity 127 extends to an underside surface 128 of the end wall and the projection 123. The thickness of the end wall is preferably less than 10 mm in order that the cooling fluid can sufficiently cool the projection. The minimum thickness of the end wall and projection is determined only by the limits of the manufacturing processes used to fabricate the anode. In practice, the thickness of the end wall is approximately 2 mm.

The fluid conduit 150 is a coaxial conduit, having an inner conduit 151 for supplying fluid, eg water, to the cavity 127 and an outer conduit 152 for removing fluid from the cavity. The inner conduit 151 extends into the cavity so that the outlet end 153 of the conduit is disposed adjacent the underside surface 128 of the end wall. This ensures that the coolest water is directed at the end wall and projection, which receives the majority of the anode heat load. The outlet 153 of the inner conduit has a notch 154 so that in the event that the inner conduit is inserted into the cavity until the conduit abuts the underside surface of the end wall, the flow of water is not restricted.

The fluid conduit 150 extends through the central aperture of the ring magnet 114 and the base plate 101 and can be used to provide an electrical connection to the anode with electrical breaks provided upstream of the connection.

Figure 5:
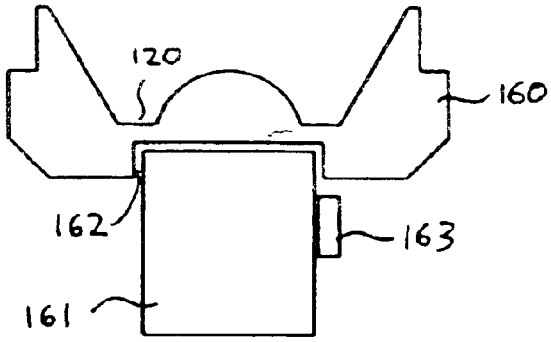
FIG. 5 shows a schematic of an anode having a heat sink.

An alternative system for cooling the anode is shown in FIG. 5. In this embodiment a solid anode 160, ie having no internal cavity, is provided with an aperture 162 extending to an underside surface of the anode end wall 120. The anode is mounted on a shaft 161 that is received in the aperture and is of a material having a high thermal conductivity, such as copper, in order to provide a heat sink for the anode. Electrical connection to the anode can also be provided using the shaft. The copper shaft 161 can extend through a feedthrough of the vacuum chamber so that the heat sink is in direct communication with the atmosphere outside the chamber to provide enhanced cooling To provide greater protection to the ion source, a thermal switch 163 may be placed on an underside surface of the anode, or on the copper shaft. Power to the ion source, for example the control signal to the mass flow controller or the anode signal, can be wired through the thermal switch. If a present temperature of the switch is exceeded, for example 100° C., the power to the ion source cuts out to prevent further heating. This protects components of the ion source such as the magnet and the projection, which can be destroyed by excessive temperatures.

Under some operating conditions, the voltage between the anode 112 and the shroud 102 can cause unwanted breakdown of the gas in the chamber 140. To circumvent this, the size of the inlet aperture 141 to the chamber 140 is made smaller than the combined sizes of the channel apertures 126 thereby preventng excess pressure in the chamber 140.

Figure 6:
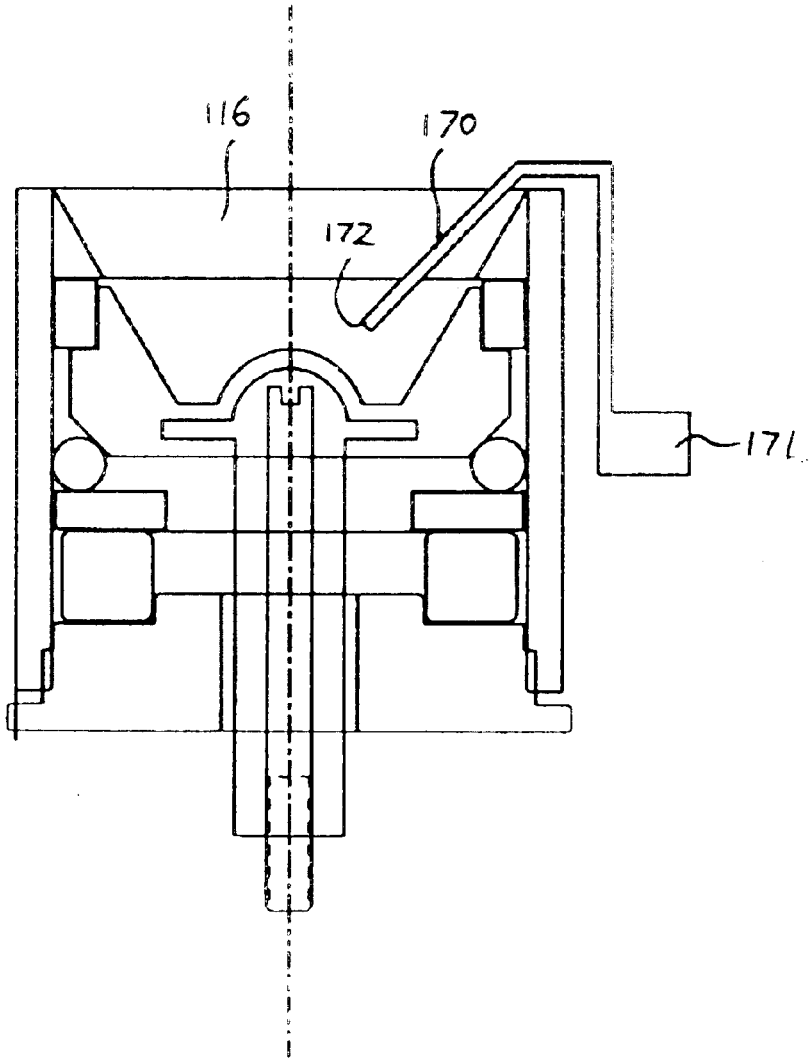
FIG. 6 shows a schematic of a further alternative gas supply system for an ion source.

Referring now to FIG. 6, there is shown a modification of the ion source shown in FIG. 4, in which the filament mountings have been removed for clarity. In this embodiment, the gas supply is comprised of one or more tubes 170 extending into the ionization region through the open end 116. Alternatively, the tubes may extend through channels in the anode side walls. In order that the tubes do not interfere with the establishment of the ion current, the tubes are non-conducting. The tubes also require a high thermal tolerance. Accordingly, a preferred material for the tubes is aluminium oxide or ceramic. The tube 170 extends from a gas manifold 171 located outside of the ionization region. The outlet of the tube 172 is provided adjacent the projection in order that the gas is provided into the ionization region at the point of highest electron concentration and electron energy, thereby increasing the ionization efficiency of the gas.

For each of the embodiments described herein, the ion beam can be maintained for a wider range of gas flow rates than for prior art ion sources because there is always at least a localised region of high pressure. The range of gas flows gives a corresponding range in the ion beam currents. A further advantage is that lower gas flow rates are required to achieve the equivalent or higher beam currents than for prior art devices. For example a gas flow rate of 4–5 sccm can achieve a beam current of 2 A in the present invention compared with 10–50 sccm required to produce 1 A of beam current in devices of the above mentioned Kaufman type. These lower gas flow rates assist in allowing a low background pressure to be maintained.

A further benefit of reduced flow rate is that the operational requirements of the vacuum pumping system used to evacuate the chamber in which the ion source is disposed can be reduced, while still maintaining lower background pressures than achieved in many prior art devices. This increases stability by reducing the chances of arcing and sputtering in the peripheral regions of the ion source.

Operating background pressures of the order $10^{-3}$ Pa have been achieved with the present invention. At these pressures the mean free path of the ions is of the order of meters. This is important in many ion source applications because it is typically many times longer then the dimensions of the vacuum environment. For LAD processes, mean free paths of this order are longer than the typical distance between the ion source and the target substrates. The efficiency of the deposition process is therefore enhanced by these low background pressures because more primary ions impact the target substrates instead of undergoing secondary collisions with gas molecules. A further benefit of the reduced pressure is that contamination of the thin film coating, is considerably reduced.

While particular embodiments of this invention have been described, it will be evident to those skilled in the art that the present invention may be embodied in other specific forms without departing from the essential characteristics thereof. The present embodiments and examples are therefore to be considered in all respects as illustrative and not restrictive, the scope of the invention being indicated by the appended claims rather than the foregoing description, and all changes which come within the meaning and range of equivalency of the claims are therefore intended to be embraced therein.

I claim:

1. An ion source comprising an electron producing cathode, an anode, an ionization region between said cathode and said anode, a gas supply path for introducing an ionizable gas into said ionization region, means for creating a potential difference between said cathode and said anode to produce a flow of electrons from said cathode toward said anode, said electron flow passing substantially through said ionization region and causing ionization of said gas, said potential difference also acting to expel ions created in said ionization region form said ion source, means for concentrating said electron flow to create a region within said ionization region where the electron flux is a maximum, wherein said gas supply path terminates in at least one aperture disposed in proximity to said region of maximum electron flux.

2. An ion source according to claim 1 wherein said potential difference creates an electric field extending away from the anode, the ion source further comprising a magnet producing a magnetic field, the axis of which is substantially parallel with said electric field.

3. An ion source according to claim 2 wherein the magnet is disposed such that the maximum of magnetic field intensity is disposed on an axis of the electric field and on the anode side of the ionization region.

4. An ion source according to claim 1 wherein said means for concentrating said electron flow comprises a projection of said anode extending into said ionization region.

5. An ion source according to claim 4 wherein said projection provides an outlet member of said gas supply path and comprises one or more apertures for introducing said ionizable gas into said ionization region.

6. An ion source according to claim 4 wherein said anode comprises an end wall, a side wall extending from the end wall in the direction of the cathode and sloping outwardly in the direction from the end wall toward the cathode such that the end wall and side wall together define a substantially conical ionization region with a closed end at the end wall and with an open end toward the cathode, wherein said projection extends from said end wall.

7. An ion source according to claim 6 wherein said gas supply path comprises one or more channels extending through said anode side wall, each of said channels terminating at an aperture disposed substantially adjacent the end wall.

8. An ion source according to claim 7 wherein each channel extends through the side wall in a direction generally toward the projection.

9. An ion source according to claim 4 wherein said gas supply path comprises one or more tubes extending into said ionization region, the, or each tube terminating in an aperture disposed adjacent the projection.

10. An ion source according to claim 9 wherein the, or each tube extends into the ionization region from the cathode end of the ionization region.

11. An ion source according to claim 4 wherein said projection has a sloped or curved surface having an apex disposed on an axis of the anode.

12. An ion source according to claim 1 wherein said anode includes an internal fluid channel adapted to receive fluid to cool said anode.

13. An ion source according to claim 4 wherein said anode includes a cavity adapted to receive fluid to cool said anode, said channel extending to an underside surface of the projection wherein the thickness of material of the projection between the ionization region and the cavity is less than 10 mm.

14. An ion source according to claim 13 wherein the thickness of the material is less than 5 mm.

15. An ion source according to claim 13 wherein the thickness of material is less than 3 mm.

16. An ion source according to claim 13 further comprising a fluid conduit extending into the cavity and terminating substantially adjacent the underside surface of the projection so that fluid provided through the fluid conduit is directed at the underside surface of the projection.

17. An ion source according to claim 1 wherein said anode is mounted on a base of electrically insulating material, said base including a channel forming part of said gas supply path.

18. An ion source according to claim 1 wherein said anode comprises at least one surface exposed to said ionization region, at least a portion of said at least one surface being of an electrically conductive non-oxidizing material.

19. An ion source according to claim 18 wherein said electrically conductive non-oxidizing material is Titanium Nitride.

20. An ion source comprising an electron producing cathode, an anode, an ionization region between said cathode and said anode, a gas supply path for introducing an ionizable gas into said ionization region, means for creating a potential difference between said cathode and said anode to produce a flow of electrons from said cathode toward said anode, said electron flow passing substantially through said ionization region and causing ionization of said gas, said potential difference also acting to expel ions created in said ionization region from said ion source, wherein said anode has at least one surface exposed to said ionization region, at least a portion of said at least one surface being of an electrically conductive non-oxidizing material.

21. An ion source according to claim 20 wherein said at least one exposed surface is a layer of Titanium Nitride coated onto said anode.

22. An ion source according to claim 20 wherein the anode comprises an end wall, a side wall extending from the end wall in the direction of the cathode and tapering outwardly in the direction from the end wall toward the cathode such that the end wall and side wall together define a substantially conical ionization region with a closed end at the end wall and with an open end toward the cathode, wherein the surfaces of the end wall and the side wall that are exposed to the ionization region are of an electrically conductive non-oxidizing material.

23. An ion source according to claim 22 wherein said anode further comprises a projection extending firm the end wall into the ionization region, wherein the surface of the projection is of an electrically conductive non-oxidizing material.

24. An ion source according to claim 20 wherein said potential difference creates an electric field extending away from the anode, the ion source further comprising a magnet producing a magnetic field, the axis of which is substantially parallel with said electric field.

25. An ion source comprising an electron producing cathode, an anode, an ionization region between said cathode and said anode, a gas supply path for introducing an ionizable gas into said ionization region, means for creating a potential difference between said cathode and said anode to produce a flow of electrons produced by said cathode toward said anode, said electron flow passing substantially through said ionization region and causing ionization of said gas, said potential difference also acting to expel ions created in said ionization region from said ion source, wherein said gas supply path comprises a gas line terminating in an electrically conductive outlet member disposed within the ionisation region, said outlet member having one or more apertures therein for providing communication of gas from the gas line to the ionization region, and wherein said outlet member is in electrical contact with said anode.

26. An ion source according to claim 25 wherein said outlet member is disposed substantially at the center of the anode.

27. An ion source according to claim 25 wherein said outlet member protrudes into said ionization region.

28. An ion source according to claim 25 wherein the, or each, aperture introduces gas into the ionization region at a localized area.

29. An ion source according to claim 25 wherein said anode comprises an end wall, a side wall extending from the end wall in the direction of the cathode and sloping outwardly in the direction from the end wall toward the cathode such that the end wall and side wall together define a substantially conical ionization region with a closed end at the end wall and with an open end toward the cathode, and wherein said outlet member extends from, and is in electrical contact with, said end wall.

30. An ion source according to claims 25 wherein said potential difference creates an electric field extending away from the anode, the ion source further comprising a magnet producing a magnetic field the axis of which is substantially parallel with said electric field.

31. An ion source comprising an electron producing cathode, an anode, an ionization region between said cathode and said anode, a gas supply path for introducing an ionizable gas into said ionization region, means for creating a potential difference between said cathode and said anode to produce a flow of electrons produced by said cathode toward said anode, said electron flow passing substantially through said ionization region and causing ionization of said gas, said potential difference also acting to expel ions created in said ionization region from said ion source, wherein said anode comprises an end wall, a side wall extending from the end wall in the diction of the cathode and sloping outwardly in the direction from the end wall toward the cathode such that the end wall and side wall together define a substantially conical ionization region with a closed end at the end wall and with an open end toward the cathode, and wherein said gas supply path comprises one or more channels extending through said anode side wall, each of said channels terminating at an aperture disposed substantially adjacent said end wall.

32. An ion source according to claim 31 further comprising an electrically conducting projection extending from, and in electrical contact with, said end wall.

33. An ion source according to claim 31 wherein each channel extends through the side wall in a direction generally toward the end wall.

34. An ion source according to claim 31 wherein said potential difference creates an electric field extending away from the anode, the ion source further comprising a magnet producing a magnetic field, the axis of which is substantially parallel with said electric field.

35. An ion source comprising an electron producing cathode, an anode, an ionization region between said cathode and said anode, a gas supply path for introducing an ionizable gas into said ionization region, means for creating a potential difference between said cathode and said anode to produce a flow of electrons produced by said cathode toward said anode, said electron flow passing substantially through said ionization region and causing ionization of said gas, said potential difference also acting to expel ions created in said ionization region from said ion source, wherein said anode comprises an end wall, a side wall extending from the end wall in the direction of the cathode and sloping outwardly in the direction from the end wall toward the cathode such that the end wall and side wall to er define a substantially conical ionization region with a closed end at the end wall and with an open end toward the cathode, and wherein said gas supply path comprises one or more tubes extending into said ionization region, each tube terminating in an aperture disposed adjacent the end wall.

36. An ion source according to claim 35 wherein each tube extends into the ionization region from the open end of the ionization region.

37. An ion source according to claim 35 wherein each tube is comprised of a non-conducting material.

38. An ion source according to claim 35 wherein said potential difference creates an electric field extending away from the anode, the ion source further comprising a magnet producing a magnetic field, the axis of which is substantially parallel with said electric field.

39. An ion source according to claim 35 further comprising an electrically conducting projection extending from, and in electrical contact with, said end wall.

40. An anode for an ion source, the anode comprising an end wall, a side wall extending from the end wall and sloping outwardly in the direction away from the end wall such that the end wall and side wall together define a substantially conical region with a closed end at the end wall and with an open end at an end of the anode opposite the end wall.

41. An anode according to claim 40 further comprising a projection extending from said end wall into said conical region, said projection being electrically conductive and in electrical contact with said end wall.

42. An anode according to claim 41 wherein said projection is integrally formed with said end wall.

43. An anode according to claim 41 wherein said conical region is substantially symmetrical about an axis of the anode, said projection being disposed on said axis.

44. An anode according to claim 43 wherein said projection provides a sloping or curved surface having an apex disposed on said axis.

45. An anode according to claim 40 further comprising one or more channels for communicating a gas through the anode to the conical region.

46. An anode according to claim 45 wherein each of said channels terminates in an aperture in a projection extending from said end wall into said conical region, said projection being electrically conductive and in electrical contact with said end wall.

47. An anode according to claim 45 wherein each of said channels extends through said side wall and terminates in an aperture substantially adjacent said end wall.

48. An anode according to claim 47 wherein each channel extends through the side wall in a direction generally toward the end wall.

49. An anode according to claim 40 further comprising a cavity adapted to receive a cooling fluid.

50. An anode according to claim 49 wherein a thickness of said end wall between said conical region and said cavity is less than 5 mm.

51. An anode according to claim 50 wherein a thickness of said end wall between said conical region and said cavity is less than 3 mm.

52. An anode according to claim 49 further comprising a projection extending from said end wall into said conical region, said projection being electrically conductive and in electrical contact with said end wall, a thickness of said projection between said conical region and said cavity being less than 5 mm.

53. An anode according to claim 52 wherein said cavity is adapted to receive a fluid conduit therein, said fluid conduit terminating substantially adjacent the underside surface of the projection so that fluid provided through the fluid conduit is directed at the underside surface of the projection.

* * * * *